US005710819A

United States Patent [19]

Tøpholm et al.

[11] Patent Number: 5,710,819

[45] Date of Patent: Jan. 20, 1998

[54] REMOTELY CONTROLLED, ESPECIALLY REMOTELY PROGRAMMABLE HEARING AID SYSTEM

[75] Inventors: Jan Tøpholm, Holte; Søren Erik Westermann, Hellerup, both of Denmark

[73] Assignee: Tøpholm & Westermann APS, Vaerloese, Denmark

[21] Appl. No.: 424,472

[22] PCT Filed: Jan. 29, 1994

[86] PCT No.: PCT/EP94/00261

§ 371 Date: May 10, 1995

§ 102(e) Date: May 10, 1995

[87] PCT Pub. No.: WO94/22276

PCT Pub. Date: Sep. 29, 1994

[30] Foreign Application Priority Data

Mar. 15, 1993 [DE] Germany ..... 43 08 157.6

[51] Int. Cl.[6] ..... H04R 25/00

[52] U.S. Cl. ..... 381/68.2; 381/68.4; 381/68

[58] Field of Search ..... 381/68, 68.2, 68.4; 128/746

[56] References Cited

U.S. PATENT DOCUMENTS

| | | | |
|---|---|---|---|
| 4,425,481 | 1/1984 | Mansgold et al. | 381/68 |
| 5,144,674 | 9/1992 | Meyer et al. | 381/68 |
| 5,202,927 | 4/1993 | Topholm | 381/68 |
| 5,303,306 | 4/1994 | Brillhart et al. | 387/68.4 |
| 5,386,475 | 1/1995 | Birck et al. | 381/68 |
| 5,479,522 | 12/1995 | Lindemann et al. | 381/68.4 |
| 5,526,819 | 6/1996 | Lonsbury-Martin et al. | 128/746 |
| 5,604,812 | 2/1997 | Meyer | 381/68.2 |
| 5,606,620 | 2/1997 | Weinfurtner | 381/68.4 |

FOREIGN PATENT DOCUMENTS

| | | |
|---|---|---|
| 0084973 | 8/1983 | European Pat. Off. . |
| 0448764 | 10/1991 | European Pat. Off. . |
| 8800629 | 5/1989 | Germany . |
| 9106237 | 7/1991 | Germany . |

*Primary Examiner*—Curtis Kuntz
*Assistant Examiner*—Xu Mei
*Attorney, Agent, or Firm*—Sughrue, Mion, Zinn, Macpeak & Seas, PLLC

[57] ABSTRACT

In a remotely controllable, especially remote-control-programmable heating aid with an external control device (1) with a keyboard (2), display device (3) and a data processing device (4) and also a hearing aid (9) controllable by the control device (1), in the control device there is a signal generator (11) actuatable and controllable via the keyboard (2) and the data processing device (4). This generator is releasably connected by a cable (12, 13, 14) to the heating aid so that the control device (1) can be used together with a heating aid to determine the hearing curve or, in general, the audiometric values of the wearer of the hearing aid in real conditions.

9 Claims, 2 Drawing Sheets

REMOTELY CONTROLLED, ESPECIALLY REMOTELY PROGRAMMABLE HEARING AID SYSTEM

BACKGROUND OF THE INVENTION

The invention relates to a heating aid system in accordance with the introductory clause of patent claim 1, which is remotely controllable, especially remote-control-programmable with respect to different transmission characteristics.

Such a hearing aid system is known, for example, from DE-A 39 00 588.7.

In the case of all previously known heating aids, whether behind-the-ear hearing aids or hearing aids worn on the concha or hearing aids capable of being largely inserted in the ear canal, determination of the heating curve is normally performed, for example, by a hearing aid specialist using an audiometer, whereby sequences of discrete tone signals with ascending and descending order, each with constantly increasing amplitude, are played back to the patient by means of headphones, and whereby the patient indicates to the hearing aid specialist that the respective hearing threshold has been reached by pressing a pushbutton, for example.

However, this method possesses a large degree of uncertainty in the otherwise always subjective result, whereby psychological influences also play a part. The main cause for the uncertainty and inaccuracy of the result can be found, on the one hand, in the fact that normally never fully sealed headphones are used to determine the audiogram or heating curve, whereas, in contrast, when a hearing aid is worn the sound is transmitted to the ear through a narrow tube and an eartip that seals the ear canal to the outside or via a corresponding ear mold or corresponding otoplasty that seals the ear canal with respect to the outer world. In other words, the sound is output to an often closed cavity (a residual volume) in front of the eardrum by a small, thin tube.

The acoustic characteristics of this type of sound transmission to the eardrum differ to such an extent from those with an open ear canal when using headphones that an uncertainty in the values obtained of up to 20 dB can be expected at higher frequencies. This uncertainty results from the normally performed calculation of the desired gain values of the heating aid, if this is done on the basis of the audiogram values obtained with headphones.

OBJECTS AND SUMMARY OF THE INVENTION

The object of the invention is to create a heating aid system of the kind mentioned at the start which permits determination, either by the heating aid specialist or the wearer of the heating aid, of a heating curve corresponding much more accurately to the actual conditions, at the same time allowing adjustment of the hearing aid to this, since the actual conditions experienced when wearing the hearing aid are present when the threshold values are determined.

This is achieved by the invention through the characteristics of patent claim 1.

Further characteristics of the invention are described in the other patent claims.

BRIEF DESCRIPTION OF THE DRAWING

The invention will now be described in greater detail on the basis of an example embodiment in conjunction with the enclosed drawing.

In the drawing.

DETAILED DESCRIPTION OF THE INVENTION

Figure 1:
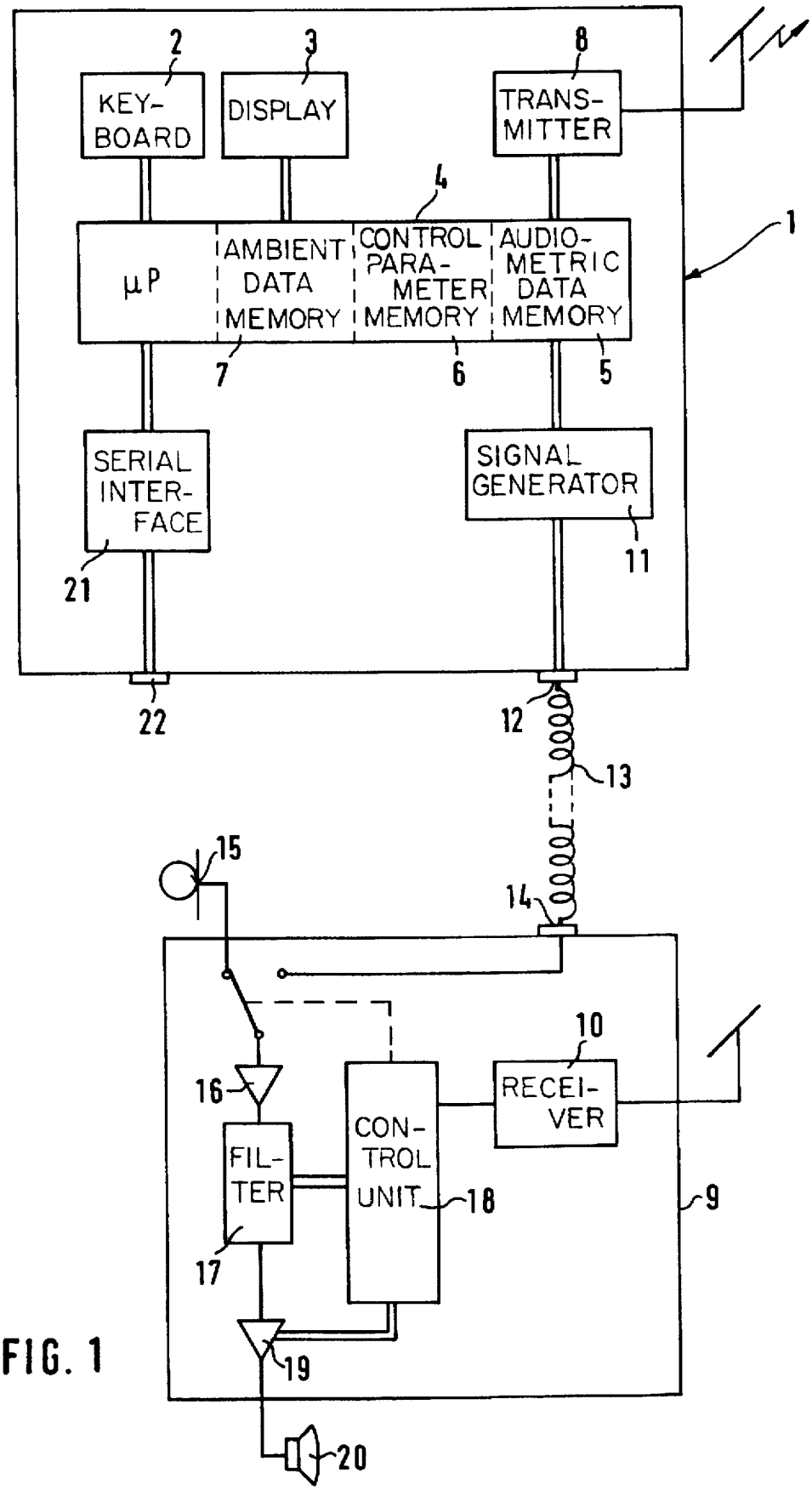
FIG. 1 shows a remotely controllable hearing aid system in accordance with the invention.

FIG. 1 shows a remotely controllable hearing aid system in purely schematic form and without any scale ratios. This system initially consists of an external control device 1, as is already known from the state of the art. This external control device 1 contains a keyboard 2, which may possess several rows of keys, pushbuttons or the alike, as well as a display device 3, which may be a liquid crystal display, for example. The keyboard 2 and the display device 3 are connected with a data processing device 4, which contains purely schematically at least a microprocessor, designated by µp, a memory 5 for audiometric data, a control parameter memory 6 and a memory 7 for storing data or parameters which are characteristic for a number of ambient situations. In addition, the external control device 1 additionally possesses a transmitter 8, which is designed, for example, for transmission of high-frequency signals, and which is connected with an antenna, which is indicated here purely schematically.

The heating aid 9, also shown purely schematically, possesses a receiver 10 to receive the signals emitted or transmitted by the transmitter 8, whereby said receiver is responsible for suitable signal processing for the purpose of controlling the transmission characteristic of the actual hearing aid.

The significant new part of the heating aid system designed in accordance with the invention is that a signal generator 11 is provided in the external control device which is also connected to the data processing device 4 and, in particular, to its memory 5 for audiometric data.

This signal generator 11 is capable by keyboard control of generating signals of all kinds in conjunction with the data processing device and in conjunction with corresponding programs/algorithms, whereby said signals are preferably tone signals, noise signals, signal mixtures of all kinds, individual signals, signals in arbitrary sequence or in arbitrary mixture and with selectable and controllable intensity.

For this purpose, various keys are provided in the keyboard 2 which permit continuous adjustment of the amplitude, i.e. the volume, of the signals generated by the signal generator 11. This can be monitored on the display device 3.

The external control device 1 also possesses a releasable connection to the heating aid 9. For this purpose, the signal generator 11 is provided with an output socket 12 for a plug connector on the housing of the external control device 1 into which a flexible connecting cable 13 can be plugged in, whereby said connecting cable possesses a plug at its other end which can be inserted in a corresponding socket 14 on the hearing aid 9. Such sockets are also known as audio jacks.

The heating aid 9 also possesses a microphone 15, a preamplifier 16 and a preferably digitally controllable filter circuit 17, which can also preferably consist of a series of such filters, whether in single-channel or multiple-channel design, which can be controlled by a control unit 18, whereby the input of said control unit is connected with the output of the receiver 10. An output amplifier 19 is provided at the output of the filter circuit 17 whose volume can also be controlled, preferably digitally, by the control unit 18. An output transducer 20 is connected to the output amplifier 19, whereby said output transducer is preferably, but not necessarily, an electro-acoustical transducer.

This new circuit arrangement now functions as follows:

The wearer of a behind-the-ear heating aid or a heating aid connected with the ear canal by way of an ear mold or of a concha heating aid or of a hearing aid capable of direct insertion in the ear canal, or also a heating aid specialist can control the signal generator 11 by means of the keyboard in conjunction with the data processing device 4 such that the said signal generator outputs acoustic signals, i.e. signals which can be made audible by way of an electro-acoustical transducer. Signal output by the signal generator 11 can be monitored on the display device 3, particularly the respective frequency or the respective signal or frequency mixture as well as its increasing or decreasing volume. Signals other than sinusoidal signals could, for example, be shown on the display device by arbitrarily chosen symbols.

Without going into further detail of the numerous possibilities for generation of an extremely wide variety of signals by the signal generator 11, the previously usual method for determination of a hearing curve or of an audiogram with the new hearing aid will be described below.

Operation of corresponding keys on keyboard 2 causes the signal generator 11 to generate a sequence of sinusoidal signals in the audible frequency range, for example.

The tone signals generated in this way are supplied at the same time to the heating aid via the plug-in cable connection 12, 13, 14. A switch is shown purely schematically in the heating aid 9 which permits switchover from the audio input to the preamplifier 16, whereby the microphone 15 is deactivated at the same time. There are various technical possibilities for this, but these will not be described in further detail here, because they do not belong to the invention. In all cases, it must be ensured by way of the cable connection 12, 13, 14 that the microphone is not active when tone signals are present at this cable connection.

In the case of this already known method for determination of an audiogram, the amplitude of each of the signals is initially changed with increasing volume until the hearing aid wearer perceives the signal or, with decreasing volume, no longer perceives the signal, whereby the said wearer or the heating aid specialist then uses the keyboard to store this signal amplitude in digital form, i.e. in the form of numeric values in the memory 5 for audiometric data, for example. The normal procedure is that a quite specific sequence of signals is generated successively in ascending form, i.e. in ascending frequencies or frequency ranges, and then in descending form. This is necessary in order to eliminate chance and subjective influences in determination of the hearing threshold of the wearer wherever possible.

As already mentioned, the signal generator can also be used to generate other signals, and especially signal mixtures, in order to simulate, for example, sequences of disturbed tone signals over the whole range or only over partial ranges. In this way, it is then also possible to carry out adjustments with respect to disturbed conditions.

The heating curve determined in this way and coded, with digital storage, for example, can then be called up by way of keyboard 2, after which the corresponding control parameters for the heating aid can be calculated from this heating curve by means of predefined mathematic operations and then stored in the control parameter memory 6. For transmission to the heating aid 9, these control parameters can then be transmitted by the transmitter 8 to the hearing aid 9 using the keyboard 2, whereby the receiver 10 of said hearing aid then controls the transmission characteristic of the hearing aid between the microphone 15 and output transducer 20 in conjunction with the control unit 18.

For the sake of completeness only, it can be mentioned here that this external control device 1 may also contain a memory 7 for the data or characteristic values of different ambient situations. This permits control of the hearing aid 9 by means of the keyboard 2 in such a way that corresponding control parameters for controlling the heating aid 9 can be derived from the control parameters derived from the audiogram and stored in the control parameter memory 6 and from the data or data groups for ambient situations contained in the memory 7.

In other words, this means that it is not necessary for any memory for ambient situation parameters to be present at all, but only a data memory for different ambient situations.

Each time when the heating aid is to be set for normal transmission, control parameters are determined for this transmission characteristic from the audiometric data in the memory 5 by means of predefined mathematical operations, whereby these control parameters are stored in the control parameter memory 6 and transmitted from here to the hearing aid 9 via the transmitter 8.

If the heating aid is to be set to a transmission characteristic for one of the ambient situations, the audiometric data from the audiogram memory 5 and the corresponding values for the ambient situation are modified to obtain new control parameters by way of given mathematical operations, whereby said new control parameters are stored in the control parameter memory 6 and transmitted to the hearing aid 9 via the transmitter 8.

In FIG. 1, a serial interface 21 is provided additionally which can be connected with an external computer via a connector 22 and which is connected internally to the data processing device. This serial interface 21 can be used, for example, to store measured data/parameters in the database of a computer. In addition, this interface can also be used to store parameters characteristic for different ambient situations in the memory 7. Finally, the whole range of functions of this external remote control device can be controlled via this interface, so that all sequences and operations can be controlled via the keyboard of a computer connected to the interface 21.

This type of control has the advantage that the audiogram itself is preserved in digital form in the memory 5 and can be called up again at any time by means of the keyboard 2, read out via the serial interface 21, for example, and output to an external data processing system.

Figure 2:
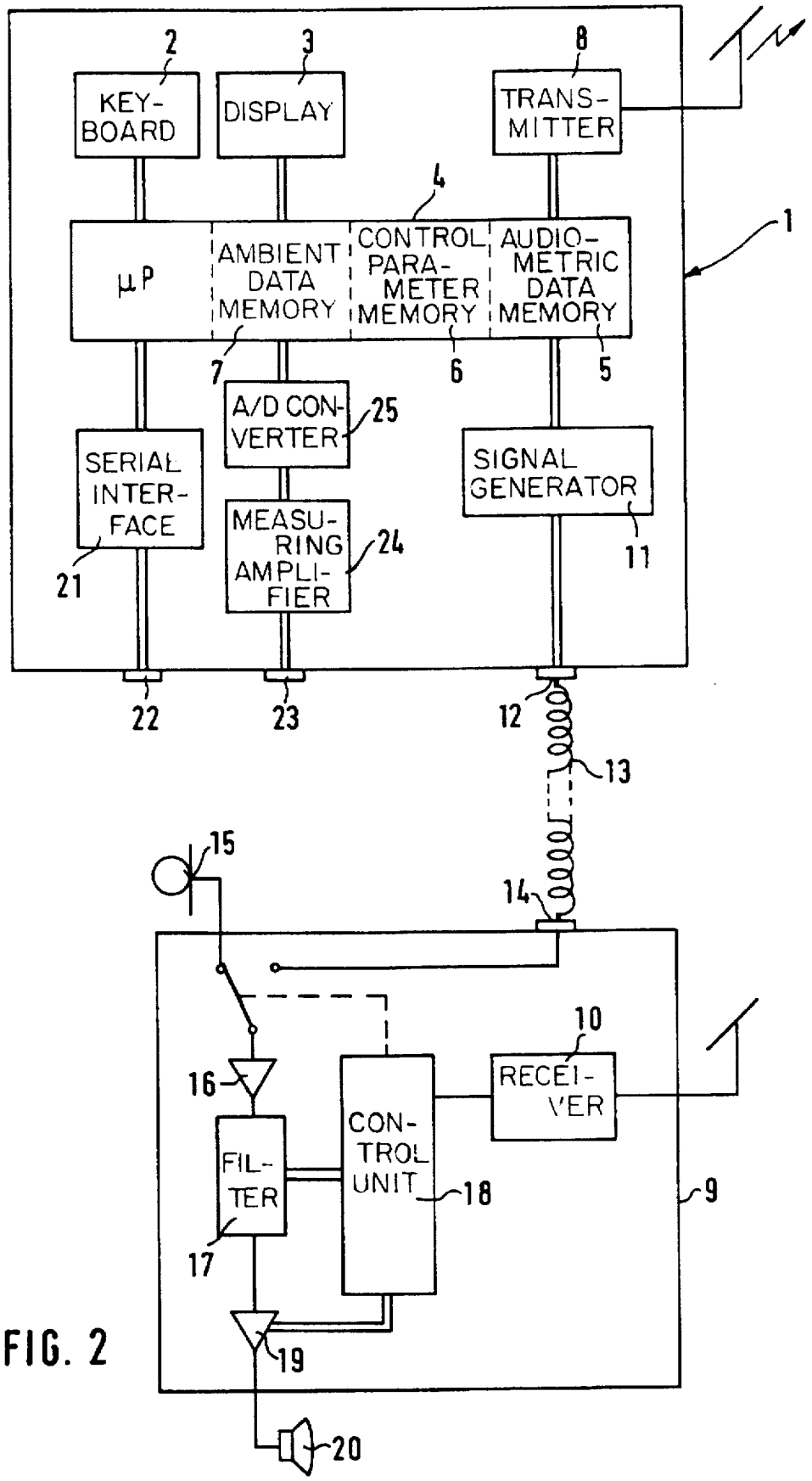
FIG. 2 shows a further embodiment of the remotely controllable hearing aid system.

The external control device shown in FIG. 2 additionally possesses a further connector 23, which is connected with a measuring amplifier 24, whose output is connected with the data processing device 4 via an analog-to-digital converter 25. The connector 23 serves to connect a cable (not shown) leading to a small test microphone, which is inserted in the residual volume between ear mold or otoplasty and eardrum and is used to measure the sound pressure generated in this residual volume. This is a very interesting supplement for this external control device, since this permits even more precise determination of the conditions in this residual volume using the signals generated by the signal generator 11. Consequently, this extension also permits even better and even more precise determination of the heating curve or audiogram of the hearing aid wearer.

The invention has thus created an external control device for a remotely controllable hearing aid system whose transmission characteristics are remotely programmable by remote control, whereby said external control device does not just permit determination of the initial setting of a heating aid taking into account a large number of different aspects, but also, if required, allows corresponding adjustment of the hearing aid at a later point in time in the event of a change in the hearing situation of the wearer. In principle, however, initial setting of the hearing aid can be performed very simply. Here, it is important above all that the audiogram stored in the memory 5 is always preserved until it is replaced by a new audiogram.

We claim:

1. A remotely controllable hearing aid system, especially with remote-control-programmable transmission characteristics, comprising an external control device (1) with a keyboard (2) for input and control functions and a display device (3) for operator prompting, with a data processing device (4) with assigned program memories and data memories, and with a transmitter (8) for wireless transmission of control parameter groups to a heating aid (9) equipped with a receiver (10) and other signal processing circuits, characterized by a signal generator (11) contained in the control device (1) and controllable by the data processing device (4) for generation of signals located mainly in the audible frequency range, and with a releasable, conductive connection (12, 13, 14) between the output of the signal generator (11) and an audio input of the hearing aid, as well as with a memory (5) for audiological or audiometric data located in the control device, whereby said memory is also operationally connected with the data processing device (4).

2. A hearing aid system in accordance with claim 1, characterized in that the signal generator (11) can be operated by means of the keyboard (2) through the data processing device (4) in conjunction with corresponding programs/algorithms to generate and output tone signals, noise signals, signal mixtures of all kinds, individually, in arbitrary sequence, in arbitrary mixture and with selectable and controllable intensity.

3. A hearing aid system in accordance with claim 1, characterized in that the determined intensity values or amplitudes of the signals generated by the signal generator (11) in each case and output to the hearing aid (9) via the conductive connection (12, 13, 14) can be stored directly as audiological or audiometric data in the memory (5) by means of the keyboard (2), and in that groups of control parameters for controlling the transmission characteristic of the hearing aid can be determined from the data by means of given mathematical operations and stored in a control parameter memory (6).

4. A hearing aid system in accordance with claim 1, characterized in that the intensity values or amplitudes of the signals generated by the signal generator (11) and output to the hearing aid (9) can be determined individually, controlled via the keyboard (2), and directly in each case by way of given mathematical operations to obtain a corresponding group of control parameters for controlling the characteristic of the hearing aid and can be stored in the control parameter memory (6).

5. A hearing aid system in accordance with claim 1, characterized in that, in addition to the first memory (5) which stores the audiometric data and the control parameter memory (6), a third memory (7) is provided for recording, storing and reproduction of data characteristic of different ambient situations, and in that groups of control parameters for setting the transmission characteristics of the heating aid (9) can be determined by the data processing device from the stored audiometric data and the data characteristic of the ambient situations by means of given mathematical operations.

6. A hearing aid system in accordance with claim 1, characterized in that a microprocessor is provided as the data processing device (4) in the external control device (1) which is connected with the keyboard (2) and the display device (3), the memory (5) for the audiometric data, the control parameter memory (6), the memory (7) for data characteristic of different ambient situations, with the signal generator (11) and with the transmitter (8).

7. A hearing aid system in accordance with claim 1, characterized in that the memory for the audiometric data, the memory for the control parameters and the memory for the data characteristic of different ambient situations as well as a memory for the algorithms/programs controlling the mathematical operations are integrated in the microprocessor.

8. A hearing aid system in accordance with claim 1, characterized in that a serial interface circuit (21) is provided in the external control device (1) which can be connected via a connection (22) and which is connected with the microprocessor in the control device.

9. A heating aid system in accordance with claim 1, characterized in that the external control device (1) possesses an additional input (23), which is connected with the data processing device (4) via a measuring amplifier (24) and an analog-to-digital converter (25), and in that a miniature microphone connectable via a cable is provided which permits the sound pressure occurring in the residual volume between an ear mold, an otoplasty or a hearing aid fitted in the ear canal and the eardrum to be measured, transmitted to the external control device and stored there.

* * * * *